United States Patent [19]

Schieber

[11] Patent Number: 4,640,103

[45] Date of Patent: Feb. 3, 1987

[54] DOUBLE HEAD FLAT KNITTING MACHINE

[75] Inventor: Hans Schieber, Bopfingen, Fed. Rep. of Germany

[73] Assignee: Universal Maschinenfabrik Dr. Rudolf Schieber GmbH & Co., KG, Fed. Rep. of Germany

[21] Appl. No.: 765,627

[22] Filed: Aug. 14, 1985

[30] Foreign Application Priority Data

Aug. 14, 1984 [DE] Fed. Rep. of Germany ..... 3429913

[51] Int. Cl.[4] ..... D04B 7/04

[52] U.S. Cl. ..... 66/64

[58] Field of Search ..... 66/64, 60 R

[56] References Cited

U.S. PATENT DOCUMENTS

| | | | |
|---|---|---|---|
| 824,565 | 6/1906 | Morris | 66/65 |
| 3,425,245 | 2/1969 | Essig | 66/64 |
| 3,908,405 | 9/1975 | Schieber | 66/78 |
| 4,463,579 | 8/1984 | Schimko | 66/78 |

FOREIGN PATENT DOCUMENTS

| | | | |
|---|---|---|---|
| 1538116 | 7/1968 | France | 66/64 |
| 473928 | 7/1969 | Switzerland | 66/65 |

*Primary Examiner*—Ronald Feldbaum

*Attorney, Agent, or Firm*—Sughrue, Mion, Zinn, Macpeak, and Seas

[57] ABSTRACT

A double head flat knitting machine includes at least one front and one rear needle bed (1,1) and two carriages (S1, S2) movable to-and-fro over the needle beds (1,1) by means of a drive (3). In order to be able to knit both normally and also oversize knitting on a single flat knitting machine with maximum effectiveness, only two needle beds (1,1) of double operative width are provided with a through-going needle space and with needles lowered into the needle beds (1,1), the drive for the carriages is a reversing drive (3) with a selectively-adjustable carriage stroke (SH) and the carriages (S1,S2) are detachably connectible with the reversing drive (3) in at least two positions.

6 Claims, 4 Drawing Figures

DOUBLE HEAD FLAT KNITTING MACHINE

Figure 1:
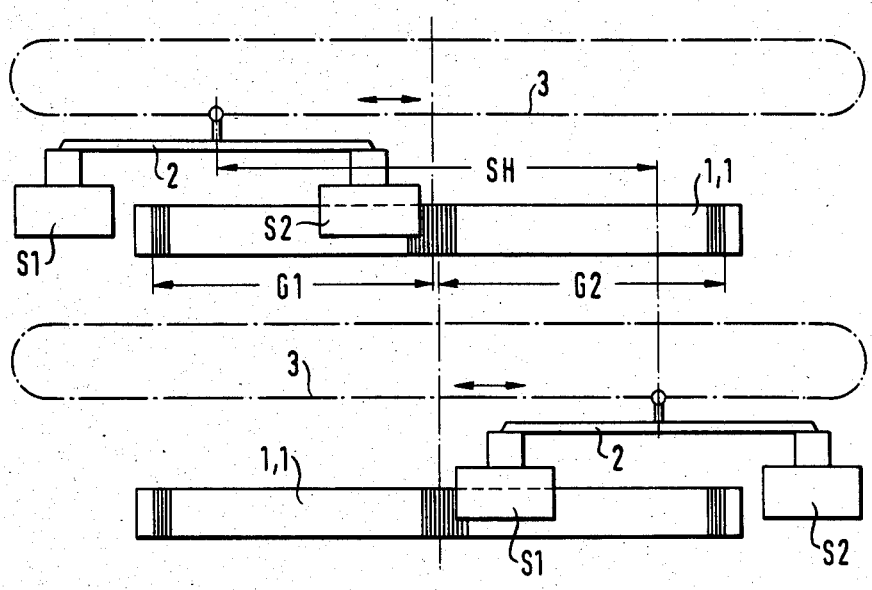

The invention relates to a double head flat knitting machine with at least one front and one rear needle bed and two carriages reciprocably moved over the needle beds by means of a reversing drive with a selectively-adjustable carriage stroke.

Known flat knitting machines include a pair of needle beds, consisting of front and rear needle beds, and a carriage which slides over these needle beds. With this arrangement, pieces of knitting with a maximum knitted width extending over the whole operative width of the needle beds or bands of different widths can be knitted, the limits of needle guidance and the needles selected or brought into the operative position by the associated selector device determining the specific width of the knitting. Such flat knitting machines as a rule have operative widths of up to about 230 centimeters. The knitting made on these flat knitting machines is cut and made up in accordance with the body configuration.

A resilient coupling member for connecting the carriage of a flat knitting machine to the carriage drive has been disclosed in German patent application Class 25a 26/10 E 2222, laid open to inspection on May 13, 1953, in which the resilience is made ineffective in a predetermined range of travel of the carriage by a blocking member.

A double head flat knitting machine of the kind described initially has been disclosed for instance in DE-OS No. 1 635 987. This double head flat knitting machine is provided with two pairs of needle beds and two carriages. The carriages each consist of three carriage parts, the middle one of which is fixedly connected to a chain and, further, to the reversing drive by means of a common connecting rod and a rocker arm. The outer carriage parts can be coupled with the central carriage part, if required. The two pairs of needle beds are located in series in the longitudinal direction and are separated so that an intermediate space is given, in which the left-hand carriage, on left carriage reverse, or the right-hand carriage, on right carriage reverse, is held or runs synchronously, during the change of functions. The maximum operative widths of each of the two pairs of needle beds amount to approximately 100 centimeters, for work on two body parts in parallel or at the same time. In contrast to a flat knitting machine with a long pair of needle beds and one carriage, the double head flat knitting machine has the advantage of a higher loading, because of the smaller carriage stroke. Thus, two pieces of knitting with up to about 100 centimeters operative width can be knitted on flat knitting machine with a long pair of needle beds and one carriage, the greater stroke of the carriage thus enabling comparison with the double head flat knitting machine at merely half the carriage movements per minute.

If body parts are knitted according to a batwing pattern, for example, then the operative width of one pair of needle beds of a double head flat knitting machine is insufficient, so that such pieces of knitting cannot be manufactured on known double head flat knitting machines, but instead a single head flat knitting machine as described above must be used.

The invention is based upon the purpose of constructing a double head flat knitting machine, of the kind described initially, so that both normal pieces of knitting (normal knitting) of smaller widths and also over-size knitted pieces (batwing garments or similar patterns) of greater operative widths can be made on it with maximum effectiveness or loading.

This problem is solved, in accordance with the invention, in that:

(a) two needle beds of approximately double operative width with a through-going or continuous needle space and with needles lowered into the needle beds are provided, and (b) the complete carriage is connectible detachably with the reversing drive in at least two places.

With such a flat knitting machine and depending upon the adjustment of the stroke of the carriage on the reversing drive, two pieces of knitting with normal widths can be manufactured parallel or simultaneously or an oversize piece of knitting can be made with the carriage stroke adjusted over the whole operative width of the needle beds with the through-going or continuous needle channel. Switching of the functions of the carriage at a reversal position is effected above the needle space with the needles lowered into the needle beds, when operating with two carriages and a half carriage stroke.

The reversing drive is advantageously a toothed belt drive with selectively-adjustable length of the to-and-fro movement of a toothed belt moving the carriage.

For operation as a double head machine, the two carriages are advantageously connectible together at a spacing of about half the needle bed width and are together connectible to the reversing drive. Alternatively, in this case, the two carriages are separately connectible with the reversing drive, at a distance of approximately half the needle bed width.

For operation as a single head machine, in manufacturing knitted goods with a width greater than half the needle bed width, one carriage is advantageously removable from the needle beds and the other carriage is connectible with the reversing drive. Alternatively, the two carriages are connectible together without any spacing and are together connectible to the reversing drive.

The operative width of the needle beds is greater than about 210 centimeters, according to a preferred embodiment of the double head flat knitting machine of the invention.

The invention is described in more detail in the following embodiments, in conjunction with the drawings.

Figure 2:
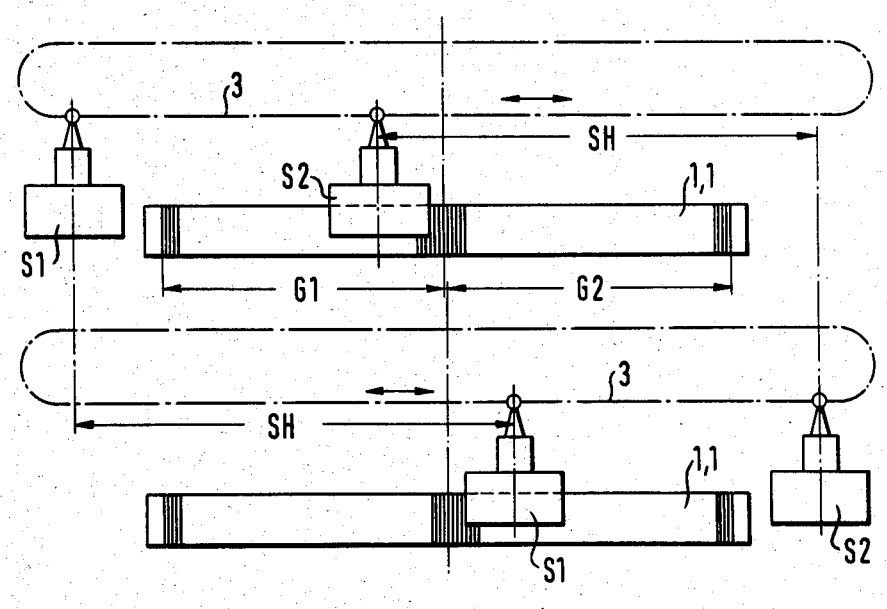
Figure 3:
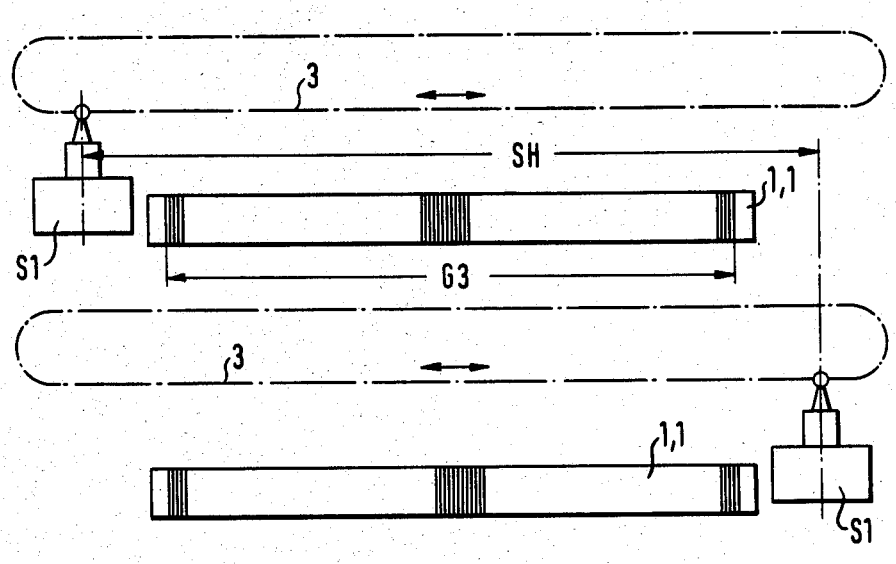
Figure 4:
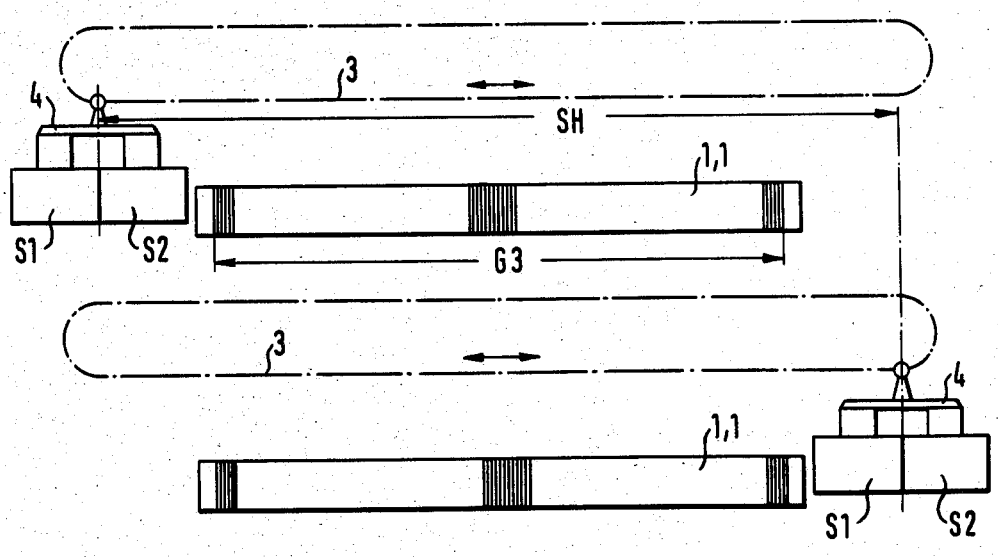

In the drawings, there are shown:

FIG. 1: a diagrammatic representation of a double head flat knitting machine according to the invention, with the carriage connected together, for operation as a double head machine:

FIG. 2: a diagrammatic representation of a double head flat knitting machine according to the invention, with the carriages connected singly to the reversing drive, for operation as a double head machine;

FIG. 3: a diagrammatic view of the double head flat knitting machine according to the invention, with only one carriage connected to the reversing drive, for operation as a single head machine; and FIG. 4: a diagrammatic view of the double head flat knitting machine according to the invention, with the carriages connected together without any spacing, for operation as a single head machine.

The double head flat knitting machine illustrated diagrammatically in FIG. 1 includes a unitary pair of needle beds 1,1, with a or continuous needle space and an operative width preferably greater than about 210 centimeters, that is at least twice the operative width of previously known double head flat knitting machines, as well as two carriages S1,S2 reciprocably movable over the pair of needle beds 1,1. In the front and rear needle beds of the pair of needle beds 1,1, lowerable needles are inserted, which are brought into operation by selector arrangements included in the carriages S1,S2 only when they are to operate directly.

The carriages S1,S2 are connected together, by means of a strap 2, at a spacing of approximately half the needle bed width and are together connected with a reversing drive 3. The reversing drive 3 is not a synchronously running chain drive, which allows the carriages always to run over the full carriage stroke, but is for example a toothed belt drive with a selectively-adjustable length of the to-and-fro movement of a toothed belt moving the carriages S1,S2. The maximum carriage stroke SH is set to a length somewhat greater than half the needle bed width plus one carriage width.

The overall length of the machine can be made shorter than in known double head machines, since the carriage S2, on left-hand carriage reversal, and the carriage S1, on right-hand carriage reversal, can slide over the needle region of the adjacent knitting, without influencing its lowered needles or needle feet. A piece of knitting G1 and a piece of knitting G2 can be made in parallel on the machine.

In the upper part of FIG. 1, the carriages S1,S2 are shown at the left-hand carriage reverse and in the lower part at the right-hand carriage reverse.

The double head flat knitting machine diagrammatically illustrated in FIG. 2 differs from the flat bed machine according to FIG. 1 only in that the carriages S1 and S2 are not connected together by means of a strap, but are connected directly to the reversing drive 3 at two places. The carriage stroke SH and the knitting drive are the same.

In FIG. 3, a double head flat knitting machine according to the invention, set up and adjusted for operation as a single head machine for making an oversize knitted piece, is illustrated diagrammatically. One carriage has been removed and the remaining carriage S1 is connected with the reversing drive 3. The maximum carriage stroke SH is adjusted to a length somewhat greater than the overall needle bed width plus the carriage width. In the upper part of FIG. 3, the carriage S1 is again in the left-hand carriage reversal position and, in the lower part of FIG. 3, it is in the right-hand carriage reversal position. On the machine, a piece of knitting G3 can be made with a maximum width corresponding to the total operative width of the pair of needle beds 1,1.

The double head flat knitting machine shown diagrammatically in FIG. 4 differs from that shown in FIG. 3 in that the two carriages S1 and S2 are connected together without any spacing by means of a strap 4 and are together connected to the reversing drive 3. The maximum carriage stroke SH is extended by the width of the carriage S2, in comparison with the carriage stroke SH in FIG. 3. The machine is thus adjusted as a single head machine, with a multi-latch carriage for higher production.

I claim:

1. Double head flat knitting machine with at least one front and one rear needle bed and two carriages reciprocably movable over the needle beds by means of a reversing drive with a selectively-adjustable carriage stroke wherein each of said front and rear needle beds is comprised of:

(a) two contiguous needle beds disposed end to end to provide an approximately double operative width needle bed provided with a continuous needle space and with needles lowered into the needle beds, and (b) at least one complete carriage detachably connected with the reversing drive at one of two positions.

2. Double head flat knitting machine according to claim 1, wherein the reversing drive is a toothed belt drive with a selectively-adjustable length of the to-and-fro movement of a toothed belt moving the carriages.

3. Double head flat knitting machine according to claim 1, wherein two complete carriages are connected together at a spacing of about half the needle bed width and are together connected with the reversing drive.

4. Double head flat knitting machine according to claim 1, wherein two complete carriages are separately connected with the reversing drive at a spacing of about half the needle bed width.

5. Double head flat knitting machine according to claim 1, wherein two complete carriages are connected together without any spacing and are together connected to the reversing drive.

6. Double head flat knitting machine according to claim 1, wherein the operative width of the contiguous needle beds is greater than about 210 centimeters.

* * * * *